United States Patent [19]

Nygren et al.

[11] Patent Number: 4,617,779

[45] Date of Patent: Oct. 21, 1986

[54] METHOD AND AN ARRANGEMENT FOR THE MANUFACTURE OF PACKING CONTAINERS

[75] Inventors: Jan Nygren, Lund; Anders Hilmersson, Helsingborg, both of Sweden

[73] Assignee: Tetra Pak International AB, Lund, Sweden

[21] Appl. No.: 530,604

[22] Filed: Sep. 9, 1983

[30] Foreign Application Priority Data

Sep. 27, 1982 [SE] Sweden ..... 8205494

[51] Int. Cl.[4] ..... B65B 31/00

[52] U.S. Cl. ..... 53/433; 53/403; 53/451; 53/511; 53/551

[58] Field of Search ..... 53/79, 403, 433, 451, 53/511, 551, 552, 554, 239

[56] References Cited

U.S. PATENT DOCUMENTS

| | | | |
|---|---|---|---|
| 2,928,219 | 3/1960 | Gubler | 53/551 |
| 2,962,843 | 12/1960 | Hoelzer et al. | 53/551 |
| 3,325,961 | 6/1967 | Lindh et al. | 53/451 |
| 3,335,540 | 8/1967 | Reil et al. | 53/451 |
| 3,423,902 | 1/1969 | Stroop | 53/551 |
| 3,470,672 | 10/1969 | Tuma | 53/551 |
| 4,081,944 | 4/1978 | Sjöstrand | 53/51 |
| 4,241,563 | 12/1980 | Müller et al. | 53/511 |
| 4,384,438 | 5/1983 | Hilmersson | 53/552 |

FOREIGN PATENT DOCUMENTS 118537 1/1970 Norway .

*Primary Examiner*—Robert L. Spruill
*Assistant Examiner*—Donald R. Studebaker
*Attorney, Agent, or Firm*—Burns, Doane, Swecker & Mathis

[57] ABSTRACT

The manufacture of non-returnable packages is frequently carried out by the conversion of web-shaped, laminated packing material to a tube, filling of the tube with milk, and sealing and forming the filled packing containers to the desired shape. During the forming, which is done by external forming devices, the contents are used as a mandrel or a holder-up for the forming device, so that the desired shape can be achieved without creasing or other deformations. The above-mentioned forming principle works less well if the packing containers are not completely filled, but have a certain air space or headspace. The proportioning of the contents also becomes uncertain and the desired accuracy of volume cannot always be achieved. These difficulties are overcome by the invention wherein a sealed off part of the packing material tube is pressurized with the help of gas during the forming process, so that the internal back pressure required during the forming is obtained, independently of the quantity of contents. The method also permits an accurate proportioning of the contents either by continuous feed at a controlled flow rate or by discontinuous feeding in portions. The invention also relates to an apparatus for the realization of the method.

11 Claims, 2 Drawing Figures

METHOD AND AN ARRANGEMENT FOR THE MANUFACTURE OF PACKING CONTAINERS

BACKGROUND AND SUMMARY OF THE INVENTION

The present invention relates to a method for the manufacture of packing containers from tubular, flexible packing material through repeated flattening, sealing and cutting of the packing material tube during the successive substantially vertically downward movement of the same.

The invention also relates to an arrangement for the realization of the method, this arrangement including guiding devices for the packing material tube, co-operating jaws for transverse pressing together and sealing of the tube, and a fill pipe.

Packing containers for milk or other, in particular liquid, foodstuffs are manufactured generally from laminated, flexible material which comprises layers of paper and thermoplastics. A known packing container is formed by successive conversion of a laminate web to tubular form while it is fed through the packing machine. In operation, the web's two longitudinal edges are joined and sealed together in a liquid-tight manner. The tube so formed is moved substantially vertically downwards through the machine at the same time as the contents are furnished via a fill pipe introduced into the upper open end of the tube and extending downwards inside the tube. At the lower end of the tube the machine is provied with reciprocating processing jaws co-operating with one another, which compress the passing material tube at regular intervals so that transverse, flattened zones are produced wherein the walls of the material tube are sealed to one another in a liquid-tight manner. The transverse sealing of the material tube is taking place below the level of the contents and the tube is thus converted to coherent, substantially cushion-shaped packing containers which are completely filled with contents. After the cushion-shaped packing containers have been separated from one another through cuts in the transverse sealing zones, a final form-processing takes place so that the packing containers obtain the desired, for example parallelepipedic shape.

During the flattening of the packing material tube as well as the subsequent form-processing for converting the cushion-shaped packing containers to parallelepipedic shape, the contents are used as an internal holder-up or "mandrel" in the packing container. That is to say the contents generate the internal back pressure which is necessary for making possible the forming of the packing container without undesirable deformation.

The principle of using of the contents as a holder-up in the forming process has worked excellently up to now, since the packing containers have been manufactured so as to be completely filled with incompressible liquid contents, that is to say without air space. If packing containers with air space or headspace are to be manufactured, the contents do not produce the same well-defined and stable back pressure over the whole surface of the packing container and this increases the risk of creasing or other deformations. The technique of manufacture described above has proved less appropriate up to now, for the manufacture of packing containers of the partially filled type.

For corresponding reasons it has not been possible to use the method for other than liquid contents, since the filling of solid particles does not produce the desired, uniform internal back pressure and creates problems with regard to the forming as well as the sealing of packing containers.

It is an object of the present invention to provide a method which allows an accurate proportioning of the quantity of contents into each packing container and which makes it possible to fill the container with solid particles (e.g., pieces of fruit etc.) together with liquid contents or separately from the liquid contents.

It is a further object of the present invention to provide a method which, without appreciable complications, can be utilized in existing packing machines of the type mentioned in the introduction.

These and other objects have been achieved in accordance with the method of the present invention wherein a sealed off part of the packing material tube is pressurized by the feeding of a gaseous pressure medium, whereupon the flattening of the tube within a limited, transverse region takes place against the effect of the internal pressure.

It is also an object of the present invention to provide an apparatus for the realization of the above-mentioned method, this apparatus being simple and reliable in operation and capable of being combined with known types of packing machines.

These and other objects have been achieved in accordance with the apparatus of the present invention wheren a bottom part of the packing material tube is sealed off by a sealing device located in the tube.

The method and the apparatus in accordance with the invention provide a number of advantages inasmuch as they overcome the above-mentioned disadvantages and make it possible to make use of known principles of package forming for the manufacture of packing containers which are only partially filled with contents. The volume of contents in each individual packing container can be regulated with great accuracy, and the filling of fluids as well as solid particles or combinations thereof is possible. By choosing an appropriate pressure medium which is not harmful to the product the method can be utilized for all types of contents occuring in practice and in aseptic as well as non-aseptic manufacture.

BRIEF DESCRIPTION OF THE DRAWINGS

A preferred embodiment of the method as well as the apparatus in accordance with the invention will now be described in more detail with reference to the enclosed schematic drawings which only illustrate the details required for an understanding of the invention and wherein.

DETAILED DESCRIPTION OF THE PREFERRED EMBODIMENT

Figure 1:
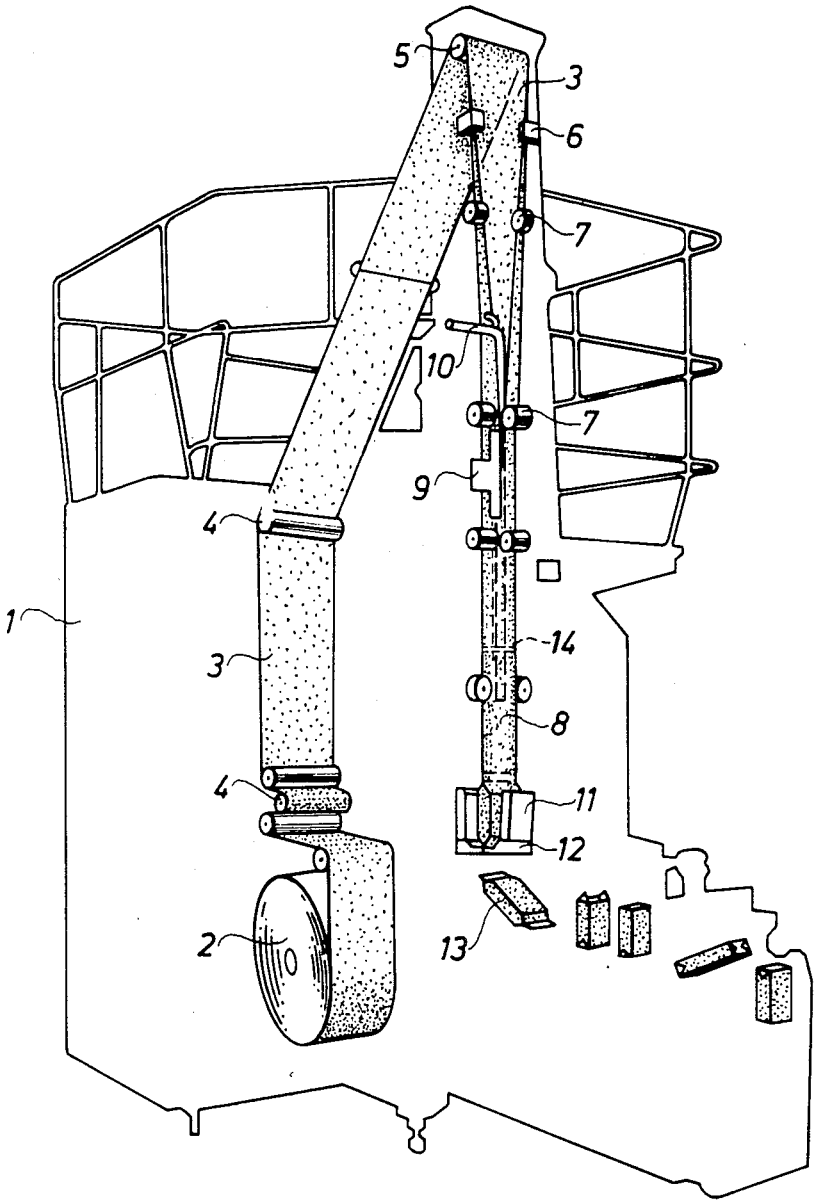
FIG. 1 is a schematic view of the conversion of a web-shaped packing material to individual packing containers is a packing machine and FIG. 2 is an enlarged sectional schematic view of the conversion of a packing material tube to individual packing containers according to the method in accordance with the invention.

The packing machine shown in FIG. 1 is of the type which converts web-shaped packing material into individual packing containers. The packing material is a laminate which generally includes a central layer of paper which is coated on either side with thin, liquid-tight layers of thermoplastic material, e.g. polyethylene. The packing laminate is provided with crease lines to facilitate the folding and conversion to finished packing containers and is fed to the packing machine 1 in the form of a roll 2 which is suspended so that it can rotate in the magazine of the packing machine. From the magazine the packing material web 3 passes via a number of guide rollers 4 up to the upper part of the machine where it pases over a reversing roller 5 to continue thereafter, substantially vertically downwards through the packing machine.

With the help of various folding and forming elements 6,7, arranged along the path of movement of the material web 3, the packing material web 3 during its downward movement through the machine is successively converted to tubular form. That is, the web's two longitudinal edges are guided towards one another and are sealed together so that a material tube 8 with a longitudinal, liquid-tight seal is produced. The sealing together of the two longitudinal edges is achieved through the supply of heat by a hot air nozzle 9, as a result of which the parts of the plastic layers located at the edges are induced to melt. The two longitudinal edges are then compressed while being cooled which means that the thermoplastic layers are joined to one another so that the desired wholly liquid-tight joint is produced.

Figure 2:
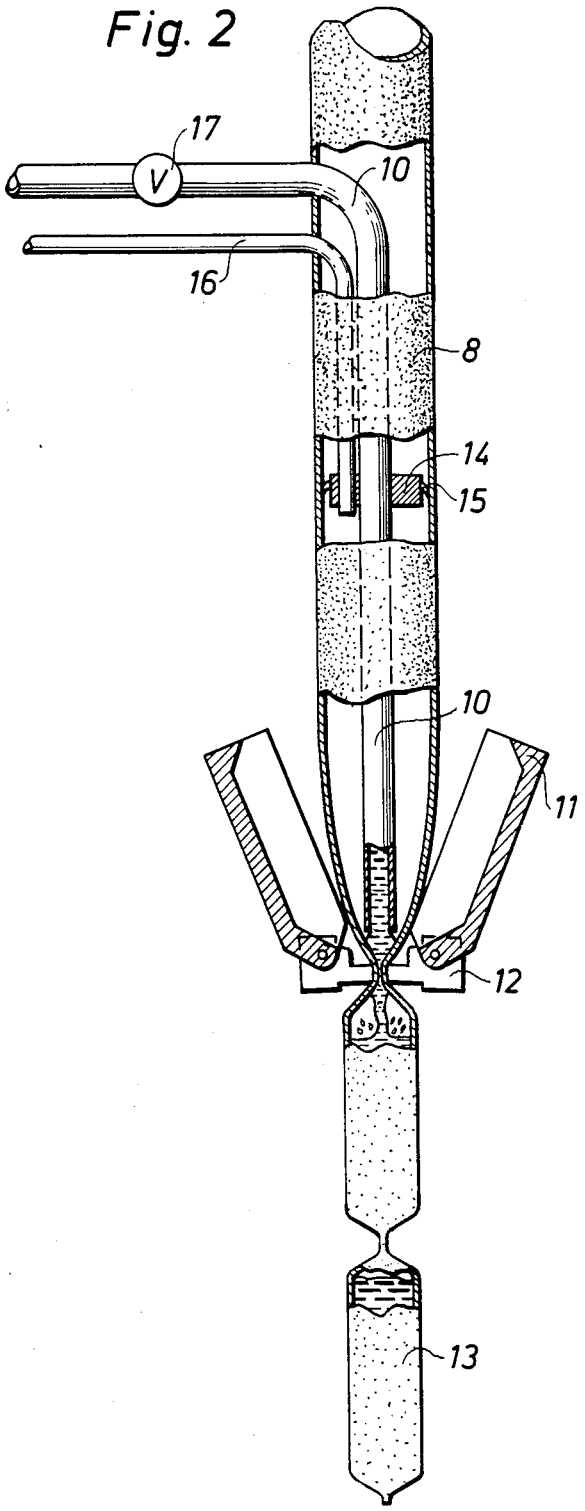

The contents are then conducted to the bottom end of the packing material tube 8 via a fill pipe 10 extending through the upper open end of the packing material tube 8. The fill pipe then runs substantially concentrically downwards through the packing material tube and opens at a little distance above the bottom end of the same. At some distance below the opening of the fill pipe 10 forming and sealing jaws 11,12 (FIG. 2), arranged on either side of the packing material tube 8, are provided which are adapted so as to process the packing material tube 8 in pairs between themselves. For the sake of clarity only one set of forming and sealing jaws is illustrated in the figures, but in practice usually a further number of jaws is provided which alternately process the packing material tube.

The sealing jaws 12 are moved continuously in the direction towards and away from each other in order to compress and seal the packing material tube along transverse sealing zones at regular intervals. The sealing jaws 12 are moved at the same time in vertical direction so that when they are in the upper end position they are moved towards one another and compress and retain the packing material tube. In the subsequent downward movement through the packing machine the walls of the packing material tube are compressed and welded to one another, the material tube being pulled forward at the same time over a distance which corresponds to the length of one packing container blank. During the downward movement the two forming jaws 11 at the same time are swivelled towards one another so that the part of the packing material tube 8 which is situated directly above the sealing jaws 12 is partially compressed and formed to the desired shape which in this case means substantially cushion-shaped with a rectangular cross-section. When the sealing jaws 12 have reached their bottom position the forming jaws 11 are swivelled out again to the position shown in FIG. 2 at the same time as the material tube 8 is cut off by means of a transverse cut in the zone compressed by the sealing jaws. As a result a packing container 13 formed previously will be detached from the packing material tube. After the sealing jaws 12 have been removed from each other again the packing container 13 is transported further by a conveyor, not shown, for continued processing and final forming so that a packing container of the desired (in this case parallelepipedic) shape is produced.

As mentioned previously, the desired contents are fed to the bottom end of the packing material tube 8 via the fill pipe 10. In continuous operation of the packing machine and manufacture of partially filled packages the contents are fed in such a rhythm that each finished packing container receives the desired quantity of contents. This can be done in two ways, namely either by a continuous feed in such a rhythm that each individual packing container formed has been filled with the desired quantity when the feed is interrupted by the flattening and sealing of the tube, or else by feeding a portion of contents of the desired volume as soon as a transverse seal has been produced in the tube. The latter method implies that each filling is completed before the upper sealing of the tube part (packing container blank) is performed which also makes it possible to portion out solid particles, such as pieces of fruit or the like into the packing container without any risk of their interfering with the flattening or sealing of the tube.

The manufacture of partially filled packing containers means of course that an air space is created in the upper end of the packing container. This air space or headspace means that the back pressure which is produced by the contents and which is required for a satisfactory form-processing varies in different parts of the packing container so that the forming becomes uncertain and the risk of faults, such as creasing, strikingly increases.

In accordance with the invention partially filled packing containers are now manufactured through continuous or discontinuous feed of contents to the material tube 8. In order to obtain the required internal back pressure during the forming in spite of the presence of an air space in the packing container, the arrangement in accordance with the invention includes a sealing device 14, arranged around the fill pipe 10 and placed at some distance above the opening of the fill pipe. The sealing device 14 has a collar-like shape and seals off the bottom end of the material tube from the surrounding atmosphere. The sealing device 14 thus rests against the inside of the material tube by means of a flexible lip seal 15 which is preferably made of silicone rubber. The sealing device 14 is carried by the fill pipe 10 and is tightly joined to the same. A through pipe 16 extends through the sealing device 14 beside the fill pipe 10. The through pipe 16 opens below the sealing device and makes possible the feed of a pressure medium to the bottom part of the packing material tube 8. The bottom part consequently is maintained under an appropriate pressure during the forming and flattening of the bottom end. The feed pipe 16 for the pressure medium, just as the fill pipe 10, passes in through the upper open part of the packing material tube and extends thereafter parallel with the fill pipe 10 downwards through the packing material tube and the sealing device 14. If necessary yet another pipe for the feed of solid contents or the like may extend down through the material tube and pass the sealing device 14. However, this is not shown on the drawing.

In the manufacture of partially filled packing containers 13, as mentioned previously, a roll 2 with appropriately web-shaped packing material 3 is placed in the packing machine 1. The packing laminate 3 passes upwards through the machine, and when it has passed the reversing roller 5 placed at the upper end of the machine it runs substantially vertically downwards while it is successively converted to tubular form by sealing together of the longitudinal edges of the web. After the sealing together to a liquid-tight packing material tube, the material passes the sealing device 14 which, because the lip seal 15 rests against the inside of the packing material tube 8, separates off a closed space between the sealing device 14 and the sealing jaws 12 at the bottom end of the tube. A gaseous pressure medium is conducted via the pipe 16 to the closed space in the packing material tube 8 so that the same is pressurized. The pressure medium, which may be sterile air, is fed at a pressure of approximately 0.25 bar which is appropriate as a back pressure for the sealing together and forming of the bottom end of the packing material tube.

During the successive advancing and flattening together with forming of the packing material tube, a constant feed of liquid contents should now preferably be performed via the fill pipe 10. The rate of feed of the contents can be adjusted by means of a constant flow valve 17 mounted on the fill pipe and be chosen so that the finished packing containers 13 obtain the desired filling ratio of for example, 90%. This filling ratio can be obtained in a simple manner if for example in the manufacture of 100 one-liter packages per minute, it is ensured that 90 liters of contents are furnished per minute, so that 0.9 liters of contents will thus be fed to each packing container between two consecutive sealings of the material tube, i.e., between the formation of the lower/upper transverse seal of an individual packing container. In the case of continuous feed of contents, the feed of contents to the bottom part of the packing material tube partly converted to a packing container will be interrupted, therefore by flattening and sealing when the desired quantity of contents has been fed to the packing container. The pressurizing of the bottom part of the packing material tube 8 provides that a satisfactory back pressure is obtained for the forming of the packing material tube in spite of the flattening and sealing of the same taking place above the level of the contents. As mentioned, the pressure medium may be constituted of a gas, such as sterile air, but it is also possible that for the filling of certain sensitive products an inert gas, preferably nitrogen, will be used. The main thing is, of course that the pressure medium should have no detrimental effect upon the contents.

Instead of continuous feed of the contents it is also possible to feed the contents in portions. The relatively slow continuous feed of contents is replaced in this case by a relatively fast feed of the desired quantity of contents in portions to each packing container directly after the bottom, transverse seal of the same has been completed. The feed is carried out relatively rapidly and each filling is completed before the upper flattening and sealing of the tube part in question is performed. Hence the contents will not be present in the sealing zone which is an advantage in the filling of products with solid particles, such as fruit pulp, since the sealing together can take place without any risk of fruit pulp adhering between the joined material surfaces or in some other way interfering with the sealing process. This also opens up a possibility of packaging non-liquid products such as flakes, large pieces of fruit or the like which may be done separately or in combination with feeding and mixing with liquid contents.

It is thus possible to introduce into each individual packing container in the first place the desired quantity of fruit via a separate proportioning pipe and to furnish then the desired quantity of liquid contents. This system is particularly appropriate for the filling of fruit yogurt.

The method and the arrangement in accordance with the invention can be used without any complications for aseptic manufacture, that is to say manufacture of packing containers for sterile products, such as milk or juice. The only precondition here is that the pressure medium used must be sterile, and that in general too, sterile conditions must exist during the filling and manufacture. This may be ensured, however, in conventional manner with the help of sterilizing media and the like. Conventional material intended for the manufacture of sterile packing containers can be used.

The method and the arrangement in accordance with the invention have been tried out in practice and found to work well. The invention makes possible not only an accurate filling of a predetermined quantity of contents into individual, only partially filled packing containers, but it also allows the furnishing and proportioning of solid particles into the individual packing containers. The arrangement is reliable and the main principle, that is to say the creation of a back pressure within the packing material tube with the help of a gas feed, has proved to make possible an accurate and safe forming of the packing container irrespectively of the type and the quantity of the contents.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A method for manufacturing and filling packing containers comprising the steps of:

advancing a continuous web of packing material in a predetermined direction;

forming said web into a tube and sealing said web longitudinally at a first location while said web advances;

conducting a liquid material through a fill pipe from above said first location;

continuously conducting gas through a gas pipe from above said first location;

sealing the tube at a zone transverse to said predetermined direction, the zone constituting a bottom of a packing container;

establishing a greater gas pressure inside said tube between said first location and said zone from gas conducted through said gas pipe;

feeding said liquid material to be packaged into the tube to a predetermined level;

applying forming jaws against the exterior of said tube after said liquid material to be packaged is fed into the tube to produce flattened sides of a predetermined shape of a packing container;

sealing said portion of said tube at a zone transverse to said predetermined direction and above the level of contents.

2. The method in accordance with claim 1, wherein the pressure gas is air.

3. The method in accordance with claim 1, wherein the pressure gas is an inert gas.

4. The method in accordance with claim 3, wherein the inert gas is nitrogen.

5. A method in accordance with claim 1 wherein the step of feeding material is continuous.

6. A method in accordance with claim 1 wherein the step of feeding material includes feeding material in intermittent batches.

7. An apparatus for manufacturing and filling packing containers comprising:

means for advancing a continuous web of packing material in a downward vertical direction;

forming means for forming said web into a tube;

seam sealing means for sealing together the longitudinal edges of said web at a first location while said tube advances;

bottom sealing means for sealing said tube at a first transverse zone thereof so as to form a bottom of a packing container, said first location being spaced vertically above said first transverse zone;

a first feed pipe for feeding a liquid to be packaged into said tube, said first feed pipe extending vertically from a location above said first location;

seal means between said first location and said transverse zone for providing a seal between the interior tube wall and said first feed pipe;

a second feed pipe for continuously supplying a pressurized gas to the interior of said tube, said second feed pipe extending vertically from a location above said seal means and through said seal means;

shaping means for shaping said tube below said first location into a packing container of desired shape while the interior of the tube is pressurized and filled with the material to be packaged; and top sealing means for sealing said tube at a second transverse zone spaced above said first transverse zone, whereby the shape of said tube is maintained by the gas pressure during operation of said shaping means.

8. The apparatus in accordance with claim 7 wherein said second feed pipe is laterally offset from said first feed pipe.

9. The apparatus in accordance with claim 7, wherein the sealing means includes a flexible lip seal resting against the inside of the tube.

10. The apparatus in accordance with claim 9, wherein the lip seal is manufactured from silicone rubber.

11. The apparatus in accordance with claim 7, wherein the first feed pipe includes an adjustable constant flow valve.

* * * * *